United States Patent [19]

Collins

[11] Patent Number: 4,587,748

[45] Date of Patent: May 13, 1986

[54] STUDDED FOOTWEAR

[75] Inventor: Roy S. Collins, West Midlands, England

[73] Assignee: Triman Limited, Tamworth, England

[21] Appl. No.: 722,424

[22] Filed: Apr. 12, 1985

Related U.S. Application Data

[63] Continuation of Ser. No. 466,962, Feb. 16, 1983, abandoned.

[30] Foreign Application Priority Data

Feb. 17, 1982 [GB] United Kingdom ..... 8204673

[51] Int. Cl.[4] ..... A43B 5/00; A43B 15/00

[52] U.S. Cl. ..... 36/127; 36/134; 36/67 D

[58] Field of Search ..... 36/127, 124, 134, 30 A, 36/67 R, 59 R, 67 D; 411/414, 423

[56] References Cited

U.S. PATENT DOCUMENTS

| | | | |
|---|---|---|---|
| 2,207,005 | 7/1940 | Haas | 411/423 |
| 2,745,197 | 5/1956 | Holt | 36/127 |
| 2,784,503 | 3/1957 | Anderson | 36/127 |
| 3,328,901 | 7/1967 | Strickland | 36/127 |

FOREIGN PATENT DOCUMENTS

| | | | |
|---|---|---|---|
| 194042 | 5/1964 | Sweden | 411/423 |
| 1236131 | 6/1971 | United Kingdom . | |
| 1404456 | 8/1975 | United Kingdom . | |

*Primary Examiner*—Henry S. Jaudon
*Assistant Examiner*—Steven N. Meyers
*Attorney, Agent, or Firm*—Scrivener Clarke Scrivener and Johnson

[57] ABSTRACT

An insert for an article of footwear is made as a unitary moulding of a flexible plastics material. It comprises a plurality of internally screw-threaded sockets, for receiving externally screw-threaded spigots on ground-engaging studs, and a support interconnecting the sockets. The support may be of laminar form and may be perforate or imperforate. Each socket may be closed at its upper end. At least one of the bearing surfaces of the internal screw-thread in each socket may be shaped so that in a cross-section containing the axis of the screw-thread the bearing surface appears as a straight line at least substantially normal to the axis. The insert may be incorporated in a sole or heel that is moulded around it or may be secured between the layers of a laminated sole or heel.

11 Claims, 10 Drawing Figures

STUDDED FOOTWEAR

Figure 1:
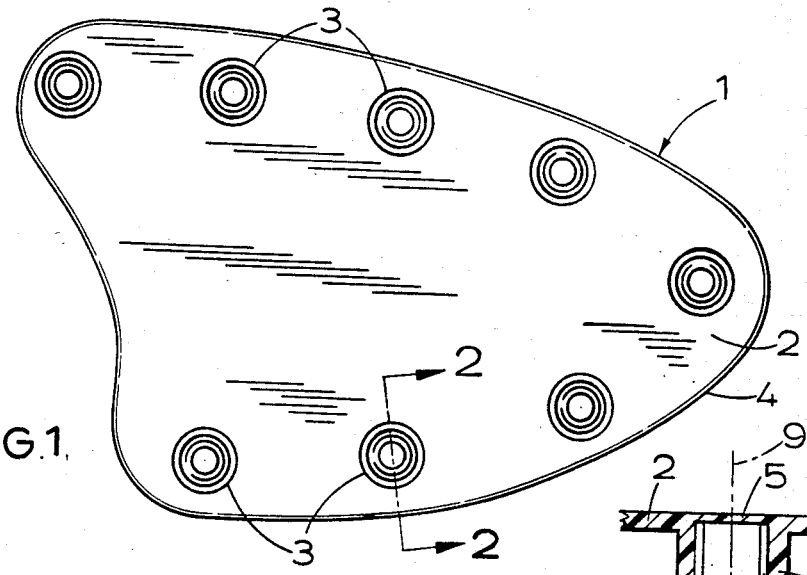

This application is a continuation, of application Ser. No. 466,962, filed Feb. 16, 1983, now abandoned.

This invention relates to footwear of the kind adapted to have ground-engaging studs, releasably attached to it. Footwear of that kind is often worn by people pursuing sports or games. The studs are generally intended to improve the grip of the footwear on the ground, and they may be of a wide variety of shapes. They may, for example be relatively blunt, with flat or rounded ends or more sharp, like spikes. For convenience of description, however, they will hereinafter be referred to generically as studs.

Detachable and replaceable studs are usually provided with spigots which are formed with external screwthreads. Each spigot can be screwed into a socket, in the underside of an article of footwear, formed with an internal screw-thread of complementary form. Hitherto it has been a common practice to manufacture a plurality of individual sockets and to attach these to, or to incorporate them within, an article of footwear. For example, in cases in which the sole or heel of an article of footwear is made as a moulding of a plastics material, a plurality of preformed sockets may be mounted in the mould and the sole or heel then moulded around them. The sockets are provided with anchorage portions which are engaged by the surrounding parts of the sole or heel and which serve to resist any tendency there may be for the sockets to become loose or detached from the sole or heel in use. When the wearer is walking or running, considerable stresses are applied to the studs, and these are transmitted to the sockets so that there may be a tendency for the sockets to become loose. Further, when a stud is being screwed into a socket or unscrewed from it, rotational forces are applied to the socket, which tend to loosen the socket and may occasionally cause part of the sole or heel to be torn or fractured, thereby permitting the socket to rotate relatively to the sole or heel about the axis of its internal screw-thread. Sometimes these difficulties can be adequately overcome or reduced by using sockets of improved design. Nevertheless, attempts have been made to overcome or reduce these problems by using, in a moulded sole or heel, an insert that is relatively extensive and incorporates a plurality of sockets. A known insert comprises a plate made of spring steel and a plurality of individually formed die-cast sockets each of which has integral tags, which are inserted into slots in the plate and are deformed to secure them to the plate. That type of insert is expensive to make and also reduces the flexibility of the article of footwear in a manner that can give rise to discomfort. It also suffers from the disadvantge that the plate is liable to rust.

From one aspect the present invention consists in an insert for incorporation in an article of footwear, comprising a plurality of internally screw-threaded sockets, for receiving externally screw-threaded spigots on ground-engaging studs, and a support interconnecting the sockets, the insert being made as a unitary moulding of a flexible plastics material.

The support is preferably of laminar form, having first and second faces which are extensive and are mutually parallel; preferably the first face is uninterrupted by said sockets and said sockets project from said second face. In use the first face is the upper face and the second face is the lower face.

The laminar support may comprise an imperforate plate or it may comprise a perforate plate, in which case the support may be of strapwork form.

Inserts embodying the present invention can be manufactured relatively inexpensively. They can also be made so that they can flex more readily than conventional spring metal plates. In particular, when a perforate plate is employed it can flex in a less restricted, more complex manner than can a metal plate, and can be designed so as to permit at least limited flexing about both transverse and longitudinal axes at the same time.

In an insert for a sole there is preferably a plurality of sockets disposed at intervals adjacent to an outer peripheral edge of the support. When the support comprises a perforate plate those sockets are preferably carried by a peripheral strap or band, which constitutes at least a part of the support and which surrounds a central area which is either entirely open or contains one or more subsidiary straps. Such an insert may be moulded in a moulding process in which the plastics material is introduced into the mould at a place at or near the central part of said area, and travels to those parts defining the peripheral strap and the sockets by way of passageways defining subsidiary straps radiating from the place of introduction.

In an insert for a heel, the support may similarly be perforate and comprise a peripheral strap carrying the sockets, but in this case it would be usual for the strap to surround a central area that was open and had no subsidiary straps. Alternatively the support may comprise an arrangement of radiating straps carrying the sockets. In another construction the support is in the form of an imperforate plate, which plate carries a plurality of sockets disposed at intervals adjacent to an outer peripheral edge of the plate.

Each of the sockets, or at least each of some of the sockets, is preferably closed at its upper end. This strengthens the socket and can lead to an improved flow of plastics material during the moulding process, it being preferable for the material to flow principally in an axial direction into the mould cavity for each socket rather than in a circumferential direction, the latter method sometimes giving rise to weakness in a completed socket where two streams of plastics material have met each other and failed to merge properly—a phenomenon known as "cold-shutting". Further, in the manufacturing process for the sole or heel, the insert can be mounted in the mould in such a manner that the material for the sole or heel flows over the closed ends of the sockets, making it unnecessary to provide means for temporarily closing the sockets to prevent the ingress of plastics material such as would be necessary if the sockets were open. Nevertheless it is within the scope of the present invention for the sockets, or at least some of them, to be open. When open, tubular sockets are employed, the bore of each socket includes an upper portion which extends inside the support; that portion of the bore may be internally screw-threaded and/or it may in use accommodate part of the spigot of the associated stud. This has the advantage that it can reduce the overall thickness of the insert.

From another aspect the present invention consists in an article of footwear having a sole or a heel incorporating an insert of a kind outlined above.

From yet another aspect the present invention consists in an insert of a kind outlined above in combination with a plurality of studs.

As mentioned above, large stresses are applied to studs, in use, and these are transmitted to the sockets. In order to reduce the adverse effects of those stresses, at least one of the studs in an insert in accordance with the present invention is preferably formed with an internal screw-thread so shaped as to include at least one helical bearing surface, for engagement with an external screw-thread on a spigot of a stud, which is defined or generated by a generatrix that extends radially from the axis of the screw-thread and is normal or substantially normal to that axis.

Thus that bearing surface is so shaped that in any cross-section of the socket containing the axis of the screw-thread the surface appears as a straight line normal or substantially normal to that axis. For convenience such a bearing surface will hereinafter be referred to as a flat bearing surface. If the generatrix of the bearing surface is at an angle of other than 90° to the axis of the screw-thread it is preferably at no more than 5° to the normal, a particularly preferred inclination from the normal being 3°.

It would be possible to make both bearing surfaces of the screw-threaded flat bearing surfaces, but preferably only one of the bearing surfaces of the screw-thread is flat.

Preferably every one of the sockets of an insert is shaped in a manner outlined above in the last paragraph but two.

When such a socket is in use, and an axial force is applied to the complementary stud, in a direction such that the thread on the spigot of the studs bears against the flat bearing surface of the thread in the socket, the force is transmitted axially to the socket, and there is little or no component of the force directed radially outwards such as would be the case if the bearing surface were inclined and not flat. In conventional sockets, with screw-threads of normal shape, both bearing surfaces are inclined. When an axial force is applied to the stud, the thread on the spigot is therefore forced against an inclined bearing surface of the socket, thereby tending to urge the socket to expand outwards. In practice it is found that a socket may occasionally split as a result of such outward forces being applied to it. When that occurs, the entire article of footwear then becomes useless. Even if the socket does not split, it may become temporarily or permanently expanded so that it no longer grips the spigot of the stud as tightly as before. As explained above, the use of a flat bearing surface reduces or prevents altogether the generation of outwardly directed forces when an axial force is applied to the stud.

Where, as is preferred, the thread of the socket is formed with a flat bearing surface facing in only one of the axial directions, this flat bearing surface is preferably directed towards the inner end of the socket, away from the open mouth of the socket, so that in use the thread on the spigot of the stud bears most strongly against it when an axial force is applied to the stud in a downward direction, that is a direction such that a force applied in that direction tends to remove the stud from the socket. Downward axial forces tend to be applied particularly strongly to the socket by the stud when a lateral force is applied to a projecting portion of the stud so that the stud is being urged by the force to tilt relatively to the socket.

The socket is preferably used with a stud having a screw-threaded spigot having a complementary flat bearing surface or complementary flat bearing surfaces (as defined above). The invention thus includes within its scope a stud, for an article of footwear, having a screw-threaded spigot, at least one of the bearing surfaces thereof being a flat bearing surface (as defined above). A stud of that kind may be used with any article of footwear having a socket provided with an internal screw-thread with a complementary flat bearing surface.

Figure 2:
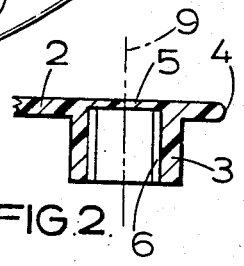
Figure 3:
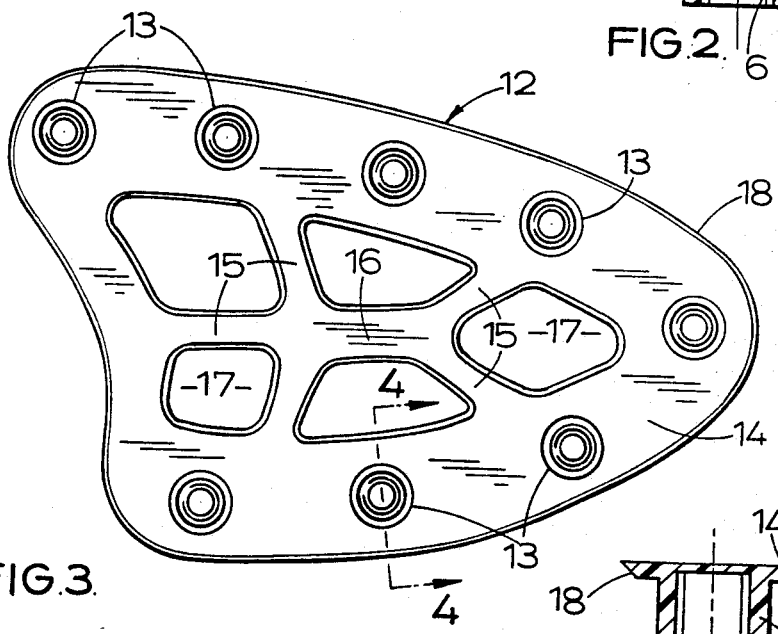
Figure 4:
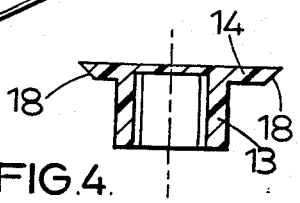
Figure 7:
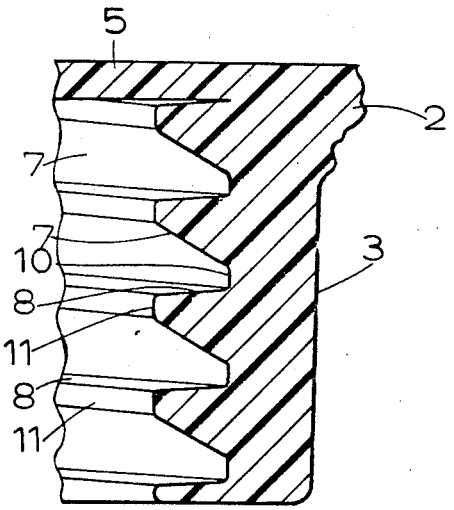
Figure 5:
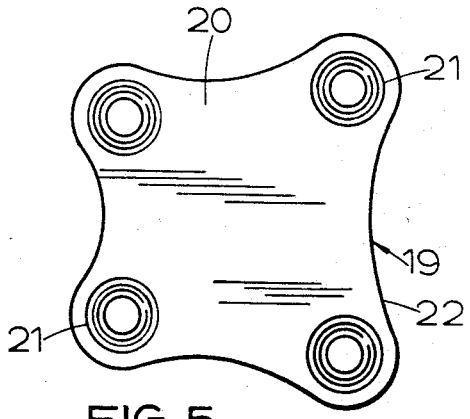
Figure 6:
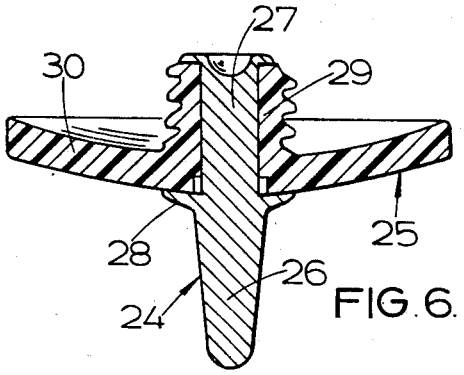
Figure 8:
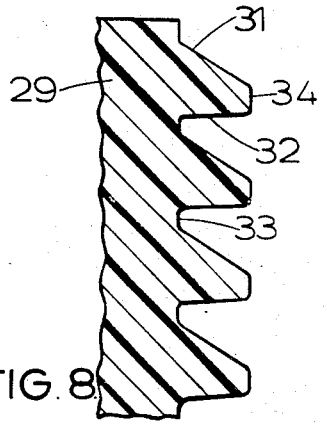
Figure 9:
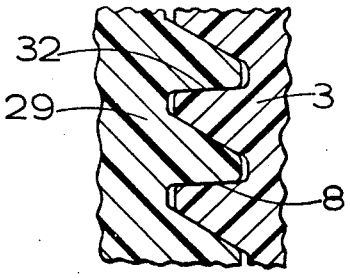
Figure 10:
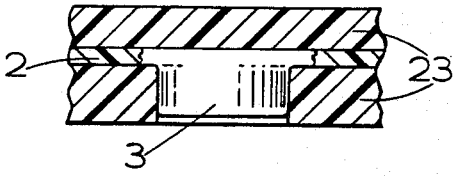

Embodiments of the present invention will now be described in more detail, by way of example, with reference to the accompanying drawings, in which:

FIG. 1 is an underneath view of an insert, embodying the invention, for incorporation in the sole of a golf shoe, FIG. 2 is a section, to a larger scale, along the line 2—2 of FIG. 1, FIG. 3 is a view, similar to FIG. 1, of another form of insert embodying the present invention, FIG. 4 is a section, to a larger scale, along the line 4—4 of FIG. 3, FIG. 5 is an underneath view of an insert, embodying the invention, for incorporation in the heel of a golf shoe, FIG. 6 is a section through a stud for use with any one of the inserts shown in FIGS. 1, 3 and 5, FIG. 7 is a section constituting part of FIG. 2, but to a much increased scale, illustrating the shape of the thread employed, FIG. 8 is a section constituting part of FIG. 6, but to a much increased scale, illustrating the shape of the thread employed, FIG. 9 is a scrap view showing parts of FIGS. 7 and 8 as they appear when the stud of FIG. 6 is engaged with the insert of FIG. 1, and FIG. 10 is a section through part of the sole of a shoe incorporating an insert embodying the present invention.

The insert 1 shown in FIG. 1 comprises a unitary moulding of a high impact acetal resin such as that marketed under the designation Delrin 100 by E.I. Du Pont de Nemours & Co. (Inc.) of Wilmington, Del. Alternatively the moulding may be made from some other strong plastics material such as ST (Super-Tough) nylon—a rubber-modified nylon—also marketed by Du Pont. The insert comprises a support plate 2, of uniform thickness, carrying on one side thereof a plurality of sockets 3 disposed at intervals adjacent to an outer peripheral edge 4 of the plate 2. The plate 2 is imperforate and is shaped to correspond approximately to the shape of the sole of a shoe. As described below, the insert is intended for incorporation in the sole of a golf shoe, and while the shape of its outline or periphery resembles that of the sole, the length and breadth of the insert are somewhat less than those of the sole so that the sole extends a short distance outwards beyond the periphery of the insert. As shown in FIG. 2, the peripheral edge 4 of the insert is of semi-circular cross-section.

Each of the sockets 3 is of generally cylindrical shape, and is closed at its upper end by a circular closure disc 5, the upper surface of which is flush with the upper surface of the support plate 1. The advantages stemming from the fact that the upper end of each socket is closed are described above. Each socket 2 is formed internally with a screw-thread 6. This is a single-start thread of a special shape in cross-section. As shown in FIGS. 7 and 9, the thread has two main bearing surfaces 7 and 8, that is helical surfaces directed generally axially of the socket and intended to co-operate with complementary faces on a stud as described in more detail below. The generatrix of the bearing surface 7 is inclined to the axis of the socket (this axis being shown at 9 in FIG. 2). The generatrix of the bearing surface 8, however, is radial to the axis 9 and substantially normal to the axis being inclined to the normal at an angle of only 3°. The bearing surface 8 is thus a flat bearing surface as defined above. At their outer ends the bearing surfaces merge into opposite edges of an inner end surface 10 of cylindrical shape. Between each groove of the thread and the next there is an unthreaded, cylindrical portion 11 of the bore of the socket.

An alternative form of insert, 12, is shown in FIGS. 3 and 4. The peripheral shape of the insert 12 is the same as that of the insert 1, and the insert 12 includes a plurality of sockets 13 similar in shape and disposition to the sockets 3. Unlike the plate 2, however, the plate of the insert 12 is perforate and comprises a peripheral strap or band 14 carrying the sockets 13 and surrounding a central area containing subsidiary straps 15. The subsidiary straps 15 radiate from a central part 16 of the insert. In the moulding process, the plastics material is injected into a part of the mould corresponding to the central part 16 and flows outwards along the subsidiary straps 15 to the peripheral strap 14 and the sockets 13. The subsidiary straps 15 subdivide the central area of the insert, that is the area within the peripheral strap 14, into subsidiary areas or holes 17 that do not communicate with each other. The edges of the straps 14 and 15 are bevelled or chamfered on their undersides, as shown at 18.

FIG. 5 shows an insert 19 which also embodies the present invention and is intended for incorporation in the heel of a golf shoe. The insert 19 comprises a support plate 20 carrying on its underside four sockets 21. Apart from its shape, the plate 20 is similar to the plate 2, while the sockets 21 are similar to the sockets 3. The insert 19 is made as a unitary moulding and may be made from a material similar to that used for the manufacture of the inserts 1 and 12.

The support plate 20 is imperforate and the sockets 21 are disposed at intervals adjacent to the outer peripheral edge 22 of the plate. In a modification (not illustrated) there is a central hole in the support plate 20.

It is intended that the insert 1, shown in FIG. 1, should be incorporated in the sole of a golf shoe. The sole is assembled from a plurality of superimposed layers or laminae adhesively secured together and stitched together around their peripheries, the stitches lying just beyond the periphery of the insert. The layers may be of leather or other suitable material or materials. The plate 2 is sandwiched between two layers of the sole and secured adhesively to them. The layer or each layer below the support plate 2 is formed with a plurality of holes corresponding in shape, size and disposition to the sockets 3 so that the sockets project into and through the holes. The layer or each of the layers above the plate 2 are imperforate. The arrangement is such that the sockets 3 terminate before the ends of the holes so that the lower ends of the sockets 3 are a short distance, for example about 1 mm, above the bottom of the sole.

In an alternative method of manufacture the sole is formed as a moulding of a plastics material, rubber or rubber-like material with the insert 1 embedded within it. To this end, the insert 1 is placed in a mould of suitable shape, and the sole or a part of the sole is moulded around it. The arrangement is such that the moulding entirely surrounds the insert except for the lower end surfaces of the sockets 2 which are flush with the bottom of the moulding or just above the bottom of the moulding (the moulded material, of course, being prevented from entering the interiors of the sockets 2). FIG. 10 is a scrap section through part of a moulded sole 23, showing the plate 2 with one of the sockets 3 extending to a position a short way above the bottom of the sole.

The insert 12 may be incorporated in the sole of a shoe in either of the ways in which the insert 1 is incorporated in the sole, which ways are described above. It is preferred however for the insert 12 to be incorporated in a moulded shoe as the material from which the sole is formed can then flow through the holes 17 in the perforate plate of the insert.

The heel insert 19 may be incorporated in a moulded heel in much the same way as the inserts 1 and 12 can be incorporated in a moulded sole. In fact the sole and heel may be moulded as a unitary whole, the heel insert 19 and a sole insert such as 1 or 12 being embedded in it. In an alternative method of manufacture, however, the heel insert is sandwiched between layers or laminae of leather or other suitable material which are nailed together adjacent to their peripheries in the conventional manner, the nails lying beyond the periphery of the plate 20. The layers or laminae, together with the insert 19 are also secured together adhesively. During assembly they may be temporarily held together, before the nails are inserted around the periphery of the heel, by means of one or more tapered nails which are inserted near the centre of the heel and later removed. That method of assembly is a conventional one. If it is used in making a heel incorporating a heel insert 19, the tapered nails may be driven through the support plate 20 or alternatively a modified form of insert may be used having a hole or holes at or near its centre through which the tapered nail or nails can pass.

Each of the inserts described above is intended for use with gold-shoe studs of any appropriate kind each having a suitably shaped screw-threaded spigot at the top. One particular form of stud is shown in FIG. 6. The stud is made in two parts, one being a central, steel pin 24 and the other being an outer plastics moulding 25. Teh lower part of the pin 24 is shaped to provide a ground-engaging portion 26, while the upper part of the pin constitutes a rivet 27. Between the parts 26 and 27 is an outwardly directed flange 28. The moulding 25 comprises an externally screw-threaded spigot 29 with an outwardly directed flange 30, of dished shape, at its lower end. In manufacture the pin 24 and moulding 25 are formed separately, the rivet 27 is inserted into the spigot 29 and riveted over as illustrated to retain the moulding in place against the flange 28. This type of construction is the subject of British Pat. No. 2028102 of Triman Limited and is described in more detail in the specification of that patent. The moulding 25 may be made from any suitable plastics material, such as an acetal resin.

The stud illustrated in FIG. 6 is characterised in that the screw-thread of the spigot 29 is of a special shape, complementary to the internal screw-thread 6 of the sockets 3. The thread form is shown in detail in FIG. 8. One of its bearing surfaces 31 has a generatrix inclined to the axis of the stud, while the other bearing surface 32 has a generatrix that is radial and subsantially normal to the axis of the stud being inclined to the normal at an angle of 3°. It is therefore a flat bearing surface as defined above. The inner edges of the bearing surfaces 31 and 32 merge into opposite edges of an inner end surface 33 of cylindrical shape. Between each groove of the thread and the next there is an unthreaded, cylindrical portion 34 of the outer surface of the spigot.

In use the spigot 29 of the stud is screwed tightly into the socket so that the flange 30 of the moulding bears against the bottom of sole or heel of the shoe and preferably becomes resiliently deformed so that it is less markedly dished in shape. The thread on the spigot 29 engages that in the socket as shown in FIG. 9, and the flat bearing surfaces 8 and 32 are pressed against each other. When the shoe is in use, lateral forces are likely to be applied to the projecting portions 26 of the studs. Such a force tends to tilt a stud in its associated socket. On that side of the stud that is urged upwards, the flange 30 presses more strongly against the underside of the sole, thus giving rise to a reaction spaced away from the axis of the stud by a distance equal to the radius of the flange 30. On that side of the stud that is urged downwards, however, it is only the engagement between the flat bearing surfaces 8 and 32 that resists downward movement of the stud. As these bearing surfaces are flat no (or substantially no) outward forces are applied by the stud to the socket such as would be the case if the flat bearing surfaces were replaced with inclined bearing surfaces like the surfaces 7 and 31. It is for this reason that the flat bearing surfaces are so disposed as to resist downward rather than upward movement of the stud in the socket.

In a modified construction (not shown) the inclined bearing surfaces 7 and 31 are also replaced by flat bearing surfaces.

It is to be understood that instead of a single-start threads, double or other multi-start threads may be used.

It is also to be understood that the use of flat bearing surfaces of the kind defined above and of the kind illustrated may equally well be used in sockets of different kinds, such as separate, individual sockets, and on studs of different kinds.

I claim:

1. For use with an article of footwear having a groung-engaging lower surface, the combination of an insert and plurality of studs for engagement with said insert, a. said insert comprising:

1. a plurality of downwardly opening cylindrical sockets internally screw threaded for receiving externally screw threaded spigots on said studs;
2. and a support interconnecting said sockets;
3. said insert being made as a unitary moulding of a flexible plastics material;
4. the screw threads in each socket being shaped to afford a helical bearing surface facing the upper end of the socket, said bearing surface being defined by a generatrix extending radially from the axis of the screw thread and at least substantially normal to said axis, whereby said bearing surface is substantially flat;

b. each of said studs comprising:

1. an upwardly facing annular face; and
2. a ground-engaging portion projecting downwards from said face;
3. said externally screw-threaded spigot projecting upwards from said face, the screw-thread on the spigot being formed of a plastic moulding defining at least a part of said spigot and being complementary to that of each socket, said thread being shaped to afford a helical bearing surface facing downwards, towards said face, said bearing surface being defined by a generatrix extending radially from the axis of the screw-thread and at least substantially normal to said axis, whereby said bearing surface is substantially flat; the arrangement being such that in use, when said insert is incorporated in an article of footwear, the spigot of a stud is screwed into a socket in the insert and said face engages the lower surface of the article of footwear, any lateral force applied to the ground-engaging portion of the stud tends to tilt the stud about an area of contact between the outer edge of said face and said lower surface whereby the spigot is biased downwards, in a direction out of said socket, that bias being resisted by the mutual engagement of said substantially flat bearing surfaces in the socket and on the spigot, and there is substantially no component of force directed radially outwards such as would be the case if the bearing surfaces were inclined, as in conventional threads, and not substantially flat.

2. The combination of claim 1 in which the support is of laminar form, having first and second faces which are mutually parallel, the first face being uninterrupted by said sockets and said sockets projecting from said second face.

3. The combination of claim 1 in which the support comprises an imperforate plate.

4. The combination of claim 1 in which the support is of strapwork form.

5. The combination of claim 4 in which the support comprises a peripheral strap carrying the sockets and surrounding a central area which is at least partially open.

6. The combination of claim 1 in which the sockets are disposed at intervals adjacent to an outer peripheral edge of the support.

7. The combination of claim 1 in which each socket is closed at its upper end.

8. The combination of claim 1 in which said generatrix is at an angle of no more than 5° to said normal to said axis.

9. The combination of claim 1 in which said upwardly facing annular face is defined by an annular flange.

10. An article of footwear having a ground-engaging lower surface, a. an insert, made as a unitary moulding of a flexible plastics material, and incorporated in said article of footwear adjacent to said lower surface thereof, said insert comprising a plurality of downwardly opening cylindrical sockets internally screw-threaded, and a support interconnecting said sockets, the screwthread in each socket being shaped to afford a helical bearing surface facing the upper end of the socket, said bearing surface being defined by a generatrix extending radially from the axis of the screw-thread and at least substantially normal to said axis, whereby said bearing surface is substantially flat and (b). a plurality of studs for engagement with said insert, each stud comprising an upwardly facing annular face, a ground-engaging portion projecting downwards from said face, and an externally screw-threaded spigot projecting upwards from said face, the screw-thread on the spigot being formed of a plastic moulding defining at least a part of said spigot and being complementary to that of each socket and being shaped to afford a helical bearing surface facing downwards, towards the flange, said bearing surface being defined by a generatrix extending radially from the axis of the screw-thread and at least substantially normal to said axis, whereby said bearing surface is substantially flat, the arrangement being such that in use, when the spigot of a stud is screwed into a socket in the insert and the face thereof engages said lower surface, any lateral force applied to the ground-engaging portion of the stud tends to tilt the stud about an area of contact between the outer edge of said face and said lower surface whereby the spigot is biased downwards, in a direction out of said socket, that bias being resisted by the mutual engagement of said substantially flat bearing surfaces in the socket and on the spigot, and there is substantially no component of force directed radially outwards such as would be the case if the bearing surfaces were inclined, as in conventional threads, and not substantially flat.

11. An insert according to claim 10 incorporated in an article of footwear in such a manner that the bottom of each socket is disposed above the level of an adjacent part of the bottom of the article of footwear.

* * * * *